US011278168B2

(12) United States Patent
Conrad, III et al.

(10) Patent No.: US 11,278,168 B2
(45) Date of Patent: Mar. 22, 2022

(54) POTTY TRAINING DEVICE

(71) Applicant: FOR KIDS BY PARENTS, INC., Potomac, MD (US)

(72) Inventors: Joseph Michael Conrad, III, Potomac, MD (US); Kurt Gans Briscoe, Jersey City, NJ (US)

(73) Assignee: FOR KIDS BY PARENTS, INC., Potomac, MD (US)

( * ) Notice: Subject to any disclaimer, the term of this patent is extended or adjusted under 35 U.S.C. 154(b) by 1 day.

(21) Appl. No.: 16/327,602

(22) PCT Filed: Aug. 25, 2017

(86) PCT No.: PCT/US2017/048558

§ 371 (c)(1),
(2) Date: Feb. 22, 2019

(87) PCT Pub. No.: WO2018/039528

PCT Pub. Date: Mar. 1, 2018

(65) Prior Publication Data

US 2019/0216276 A1 Jul. 18, 2019

Related U.S. Application Data

(60) Provisional application No. 62/379,280, filed on Aug. 25, 2016.

(51) Int. Cl.

| | |
|---|---|
| ***E03D 9/00*** | (2006.01) |
| ***A47K 13/24*** | (2006.01) |
| ***A47K 17/00*** | (2006.01) |

(52) U.S. Cl.
CPC ..... *A47K 13/24* (2013.01); *A47K 17/00* (2013.01)

(58) Field of Classification Search
CPC ..... A47K 13/24; E03D 9/00
USPC ..... 4/237
See application file for complete search history.

(56) References Cited

U.S. PATENT DOCUMENTS

| | | | | |
|---|---|---|---|---|
| 4,716,602 | A | 1/1988 | Brickhouse | |
| 6,473,911 | B2 | 11/2002 | Weiss | |
| 6,708,350 | B2 | 3/2004 | Devereux | |
| 2006/0260031 | A1* | 11/2006 | Conrad, III | A47K 13/24 4/300.3 |
| 2007/0151009 | A1 | 7/2007 | Conrad, III et al. | |
| 2014/0020165 | A1* | 1/2014 | Conrad, III | A47K 13/24 4/300.3 |

* cited by examiner

*Primary Examiner* — Lauren A Crane
(74) *Attorney, Agent, or Firm* — Norris McLaughlin, P.A.

(57) ABSTRACT

A potting training device for preventing a potty training child's urine stream from passing through an opening between the toilet seat and the toilet bowl is made of a flexible, water-resistant, preferably non-porous flat sheet material, having a folding seam separating the device into an top portion containing a plurality of attachment tabs and a bottom portion containing a urine-deflector. An adhesive material is applied to the surface of each attachment tab and attaches the attachment tabs to the underside of the toilet seat. The flat sheet material, in its unattached configuration, is manipulated into a curved configuration that matches the curvature of the toilet seat, and is attached thereto.

11 Claims, 3 Drawing Sheets

POTTY TRAINING DEVICE

CROSS REFERENCE TO RELATED APPLICATIONS

This application claims priority of U.S. Provisional Application No. 62/379,280, filed Aug. 25, 2016, the entire content of which is incorporated herein by reference.

STATEMENT REGARDING FEDERALLY SPONSORED RESEARCH

Not applicable.

FIELD OF THE INVENTION

This invention is directed to a potty training device that functions as a urine-deflector when attached to the underside of an adult sized toilet seat. The invention is designed to block the opening formed between the toilet seat and the toilet bowl. This invention reduces accidental wetting of clothing and the floor that occurs when a child's urine stream passes through the opening between the toilet seat and the toilet bowl.

BACKGROUND OF THE INVENTION

It is a major accomplishment for a child to reach the stage of sitting on an adult toilet during potty training. Obtaining control over the direction of urine flow, however, may take some time for a child to master, particularly a male child. When sitting on the toilet, a child's urine stream is not always directed into the toilet. There are occasions where the child's urine stream finds its way out of the toilet through the opening formed between the toilet seat and the toilet bowl. This results in the urine stream coming in contact with the child's pants or other clothing and the floor. This can be very upsetting for a child who is trying to do their best to stay dry and master going to the toilet, as well as the parent who has to continually clean up the mess.

Urine deflecting devices are not new to the art. Many of the known devices, however, are designed for adult males to prevent urine from splashing onto the seat during urination from a standing position. Few potty training devices address preventing the urine stream from passing through the opening between the toilet seat and toilet bowl.

Truettner (U.S. Pat. No. 6,289,527) discloses a molded plastic device that attaches to the underside of the toilet seat to prevent a child's urine stream from passing through the opening formed between the toilet bowl and the toilet seat. When attached to the underside of the toilet seat, the prior art device is not visible when the toilet seat is down, unless viewed from a position to the rear of the attachment point.

However, this prior art device is bulky, which results in increased manufacturing and sales costs. The device is also difficult to clean and frequent replacement increases expense for the consumer. Another drawback is that the prior art device has a fixed configuration. Given the variety of toilet seat shapes, the fixed configuration of the prior art device limits its compatibility with many toilet seats. Therefore, in order to accommodate the full range of toilet seat shapes, the prior art device would have to be manufactured in a variety of configurations, adding additional expense to manufacturing costs and to the consumer.

What is needed is an inexpensive device that is effective for blocking the opening formed between the toilet seat and the toilet bowl, requires minimal manufacturing cost, and is easy to clean and replace without significant expense to the consumer. Additionally, there is a need for a single device that is flexible enough to match the curvature of any toilet seat and still remain hidden when the toilet seat is down, unless viewed from a position to the rear of the attachment point. The device of the present invention meets these needs and others.

The device of the present invention is made of a flexible, water-resistant, preferably non-porous sheet material, comprising a folding seam, a urine deflector wherein the urine deflector has a urine-deflecting surface, and a plurality of attachment tabs. The term "urine deflector" can be used interchangeably with the term "urine-deflecting surface", throughout this application. The device has an initial flat configuration that is manipulated into a curved configuration, which is then attached to the underside of a toilet seat. An adhesive material is applied to the surface of each attachment tab and bonds the attachment tabs to the underside of the toilet seat. The urine-deflector hangs down from the underside of the toilet seat, blocking the opening between the toilet seat and the toilet bowl and, therefore, also, any urine directed towards such opening.

With the earlier version of the device covered in U.S. Pat. No. 7,870,619 (hereinafter "'619 Patent" or "'619 device"), the entire contents of which are incorporated herein by reference, we discovered that when the folding seam is positioned on the front side of the '619 device, and the cross-sectional thickness of the device increases (hereinafter, "thicker versions" of the device), folding the device in a manner that decreases an angle between the top portion and bottom portion on the back side of the device, creates a configuration where the folding seam opens up to form a structural shelf that can collect and accumulate urine when the device is attached to the toilet seat. Absent more frequent cleaning of the device, the accumulation of urine on the structural shelf may over time become strongly malodorous. Additionally, we found that when thicker versions of the '619 device are attached to the underside of the toilet seat and a structural shelf is present, gaps between adjacent attachment tabs that could allow urine to pass through may also form. Neither the structural shelf nor the gaps between attachment tabs for thicker versions of the '619 device are preferred structural elements.

In one prior attempt to remove the structural shelf and gaps that can appear in thicker versions of the '619 device, we modified the '619 device to remove the folding seam and created a fixed angle between the plurality of attachment tabs and the urine deflector portion of the device, wherein the fixed angle was preferably a 90 degree angle, as shown in pending U.S. patent application Ser. No. 13/554,193 (hereinafter, the '193 device), the entirety of which is incorporated herein by reference. The '193 device has an "L-shaped" configuration defined by the fixed angle between the plurality of attachment tabs and the urine deflecting portion of the device.

We have since discovered an additional structural modification that effectively removes the above described structural shelf and gaps seen in thicker versions of the flat '619 device, while at the same time, maintaining the initial flat configuration of the device. Specifically, we have found that by relocating the folding seam from the front side of the '619 device to the back side of the device, when the device is folded in a manner that decreases the angle between the top portion and bottom portion on the back side of the device, and is subsequently attached to the toilet seat, the structural shelf is eliminated, and the aforementioned gaps between attachment tabs are substantially eliminated as well.

The above referenced modification as applied to thicker versions of the present device also improves the sanitary characteristics of the device by substantially eliminating or reducing: (i) the collection and accumulation urine on a structural shelf seen in the '619 device; and (ii) formation of gaps that could allow urine to pass through, thereby contributing to odor development and the need to clean the device more frequently. The present modification also allows for reduced manufacturing costs, as the fixed angle '193 device requires more expensive manufacturing in three dimensions; whereas the flat configuration of the present device requires less expensive two dimensional manufacturing methods. For example, if an injection molding process is used to manufacture the device of the present invention, the mold production process is significantly less expensive for flat (2-dimensional) product, compared to that for a 3-dimensional product.

Accordingly, there is now a need for a device that has all the advantages of the device disclosed in our prior patent, but none of the device's discovered structural and functional disadvantages. These and other objects are met with the present invention, described hereinbelow.

BRIEF SUMMARY OF THE INVENTION

When attached to the underside of a toilet seat, the potty training device of the present invention effectively blocks the opening formed between the toilet seat and the toilet bowl and provides a simple and inexpensive solution to the above-described problems. For thicker versions of the '619 device, the present invention relocates the folding seam from its position on the front side of the '619 device to the same position on the back of the device. Once the modified device of the present invention is folded in manner that decreases the angle between the top portion and bottom portion on the back side of the device, and subsequently attached to the toilet seat, the resulting configuration removes the structural shelf and gaps seen in thicker versions of the '619 device.

In its unattached configuration, the potty training device of the present invention has a flat configuration and comprises a bendable (or flexible) urine-deflector, a folding seam, wherein said folding seam is positioned on the back side of the device and is oriented horizontally across the width of the device; a plurality of attachment tabs, wherein each attachment tab further comprises a means for attaching the device to the underside of a toilet seat. In an embodiment of the present invention, each attachment tab has layered thereon, an adhesive material, which provides the means for attaching the potty training device to the underside of the toilet seat.

The potty training device of the present invention is therefore manufactured to have a "flat" configuration and is optionally prepackaged in the same flat configuration (i.e., before sale and/or user manipulation and attachment to the underside of the toilet seat), as shown in FIGS. 1-3. The invention in one embodiment, therefore, relates to an optionally sealed package, to be opened by a consumer-user, containing the potty training device having the flat configuration.

The device of the present invention therefore comprises a top portion, a bottom portion, a left edge, a right edge, a front side and a back side, and a folding seam, wherein the folding seam separates the top portion from the bottom portion of the device. The top portion of the device of the present invention further contains the attachment tabs and the bottom portion of the device contains the urine deflector.

In defining the "front side" and "back side" of the device, the "front side" is the side of the device to which a urine stream makes direct contact. The "back side" is the side that does not make direct contact with a urine stream. The "back side" can also be defined as the side that the consumer sees when viewed from the front of a toilet seat to which the device is attached.

The potty training device of the present invention is attached to the underside of a toilet seat, by manipulating the device from its initial flat configuration as shown in FIGS. 1-3, by: (1) orienting the device with the folding seam facing the individual installing the potty training device, placing the top edge of each attachment tab against the surface of the underside of the toilet seat at a desired location; (2) pressing the top edge of each attachment tab against the surface of the toilet seat, thereby folding the attachment tabs along the folding seam, thereby resulting in the device having an L-shaped configuration, as shown in FIG. 4, such that the angle between the attachment tabs and the urine deflector on the backside of the potty training device is about 90 degree, and (3) while maintaining contact between the top edge of each attachment tab and the surface of the underside of the toilet seat at a desired location, bending the left and right edges of the flexible urine-deflector inward, thereby resulting in the curved configuration shown in FIG. 5, and (4) pressing the attachment tabs against the underside of the toilet seat to engage the adhesive material on each attachment tab with the surface of the toilet seat, such that the angle between the attachment tabs and the urine deflector on the backside of the potty training device is about 90 degree, as shown in FIGS. 4 and 7.

The potty training device of the present invention may be manufactured from any material that is flexible, water-resistant and preferably non-porous. The material used to manufacture the potty training device should also be strong and flexible enough to resist tearing or breaking during manual manipulation and attachment to, and removal from, the underside of the toilet seat.

For the purposes of description, reference to the device of the present invention may optionally be referred to as "device" or "potty training device." Reference number 1 in the relevant figures refers to either a single attachment tab or a plurality of attachment tabs. When referring to more than one attachment tab, the phrase "plurality of attachment tabs" is used throughout the specification, unless otherwise indicated. The use of the terms "bendable" and "flexible" are used interchangeably throughout the specification and are taken to have the same meaning. The terms "bendable" or "flexible" may optionally appear before the term "urine-deflector" throughout the specification. In the absence of the terms "bendable" or "flexible" preceding the term "urine-deflector", it is understood that the "urine-deflector" possesses the characteristic of being "bendable" or "flexible."

DETAILED DESCRIPTION OF THE INVENTION

Figure 1:
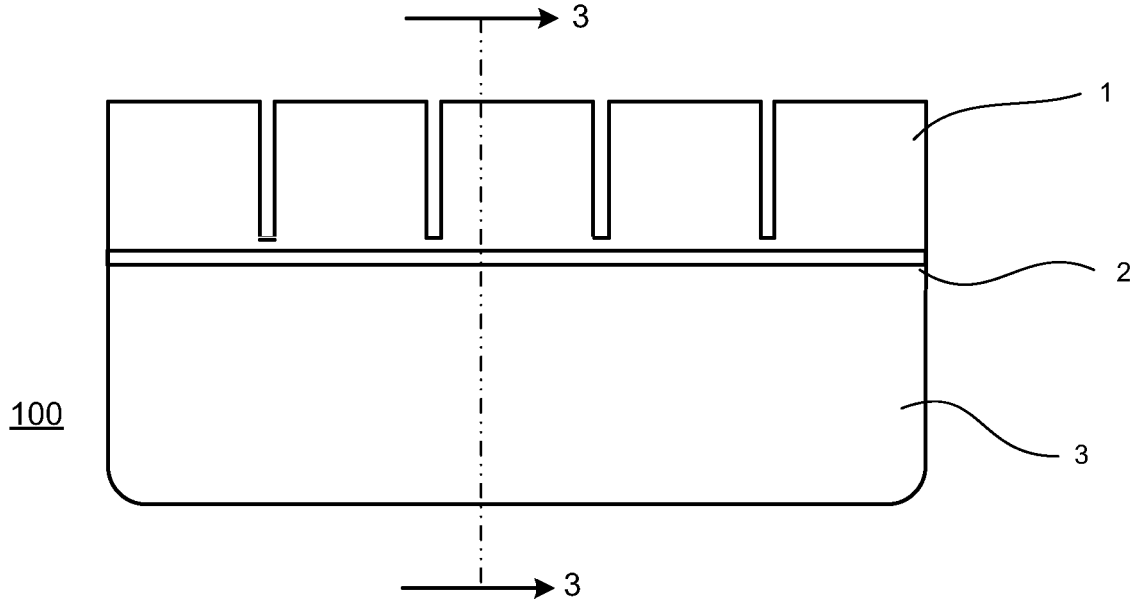
FIG. 1 is a top view of the "back side" of the potty training device of the present invention in its flat configuration.

The present invention is directed to a potty training device 100 having a substantially flat configuration, comprising a bendable urine-deflector 3, a plurality of attachment tabs 1, a folding seam 2 positioned on the back side of the potty training device 100, and a means for attaching the potty training device 100 to the underside of a toilet seat 50. More specifically, the potty training device 100 is configured such that the folding seam 2 separates the potty training device 100 into a top portion comprising, a plurality of attachment tabs 1 and a bottom portion, comprising the urine deflector 3.

Figure 7:
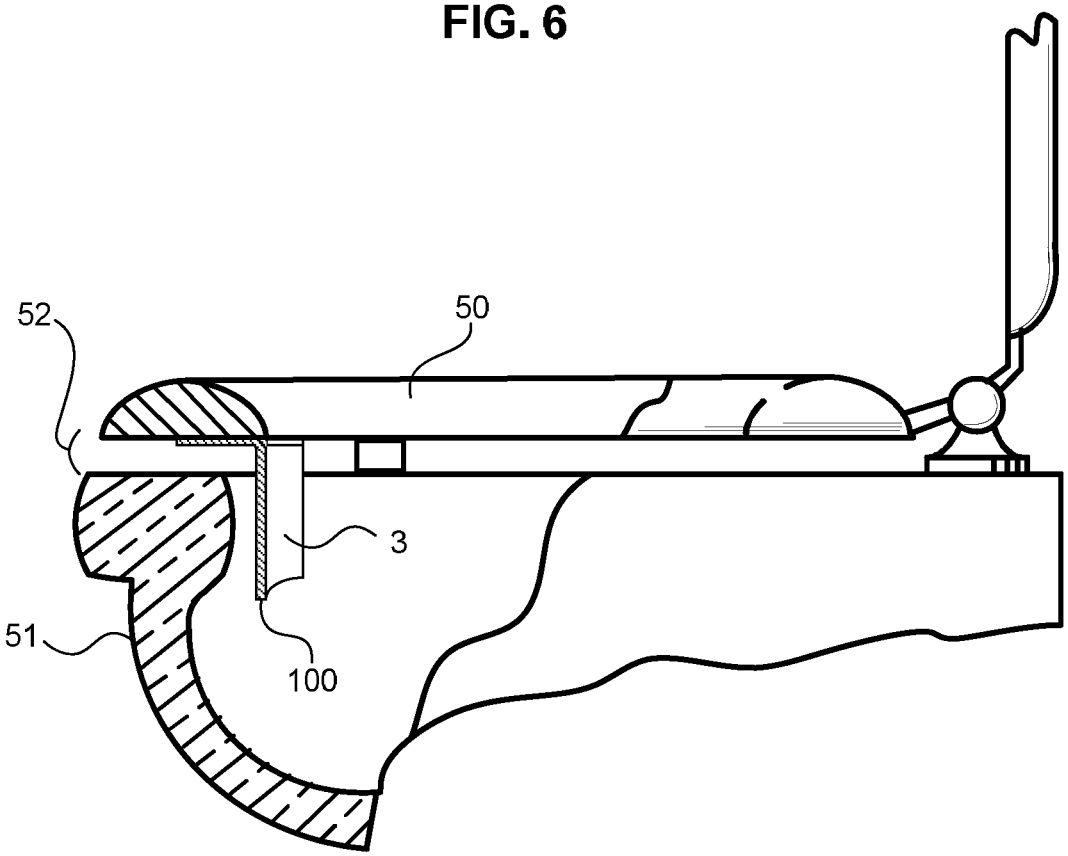
FIG. 7 is a cross-sectional side view of the urine-deflector attached to the underside of a toilet seat, as depicted in FIG. 6, taken along the line 7-7.

The means for attaching the potty training device 100 to the underside of the toilet seat 50 allows the bendable urine-deflector 3 to be positioned in a curved configuration to block the opening 52 formed between the toilet seat 50 and the toilet bowl 51, to allow a front side surface of the bendable urine-deflector 3 to function as a urine-deflecting surface to deflect a urine stream directed towards the opening into the toilet bowl 51, as shown in FIG. 7.

In its attached curved configuration, the front side urine deflecting surface of the bendable urine-deflector 3 faces to the rear of the toilet seat. The flexibility of the potty training device 100 allows for manual manipulation into various curvatures, so as to accommodate the shape of many different toilet seats.

Figure 2:
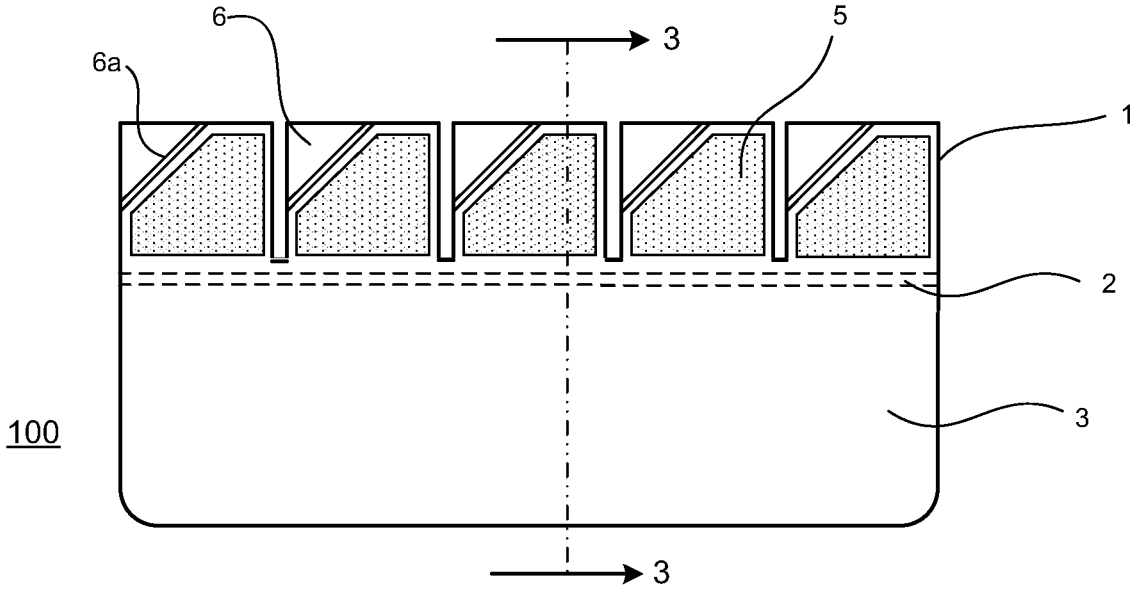
FIG. 2 is a top view of the "front side" of the potty training device of the present invention in its flat configuration.

The urine-deflector 3 preferably has a rectangular configuration, as shown in FIGS. 1 and 2. The height of the urine-deflector 3 is defined as the length from the top edge to the bottom edge of the urine-deflector 3. The top edge of the urine-deflector 3 is in contact with the bottom edge of the folding seam 2. The width of the urine-deflector 3 is defined as the length between its left edge and right edge. The width of the urine-deflector 3 is greater than its height.

The width of the urine-deflector 3 is selected to provide sufficient coverage for the variation in the lateral direction of a child's urine stream. While not intending to be limited to any particular width for the urine-deflector 3, preferred widths are from 6-9 inches. The height of urine-deflector 3 is selected to allow the urine-deflector 3 to completely block the opening formed between the underside of the toilet seat 50 and the top of the toilet bowl 51. While not intending to be limited to any particular height for urine-deflector 3, preferred heights range from 1-3 inches. In a particular embodiment of the invention, the urine-deflector 3 has a rectangular dimension of 6 inches by 3 inches or 6 inches by 1.5 inches.

Additionally, the dimensions of the urine-deflector 3 are sufficient to avoid contact with the toilet bowl 51 when the toilet seat 50 is lifted to, or lowered from, a vertical position. Further, the potty training device 100 once attached, is not visible to the observer unless the toilet seat 50 is raised, is in an upright vertical position or is viewed from a position to the rear of the attachment point when the toilet seat 50 is down.

The present invention is also directed to a potty training device 100 comprising a bendable urine-deflector 3, a plurality of attachment tabs 1, and an adhesive material 5 applied to each attachment tab 1, wherein the adhesive material 5 attaches the potty training device 100 to the underside of a toilet seat 50.

The potty training device 100 of the present invention may comprise any number of attachment tabs 1. Depending on the size of the width of the urine-deflector 3, from 4-10 attachment tabs 1 are preferred. An odd number of attachment tabs 1 is particularly preferred, because the center attachment tab provides a visual reference point for centering the potty training device 100 at the attachment point on the underside of the toilet seat 50. Thus, in a particular embodiment of the invention, 5, 7 or 9 attachment tabs 1 are preferred. All attachment tabs 1 preferably have the same dimensions and are evenly distributed across the width of the urine-deflector 3.

In order to attach the potty training device 100 to the underside of the toilet seat 50, an adhesive material 5 is applied on each attachment tab 1. The adhesive material 5 can be applied by any suitable means, for example, by layering, coating or printing, and the adhesive is, preferably, applied as a solid layer, although it is also possible to apply the adhesive in a pattern of discrete islands of adhesive, for example, in the form of dots or squares or other shapes, as is well known in the adhesive arts.

Figure 3:
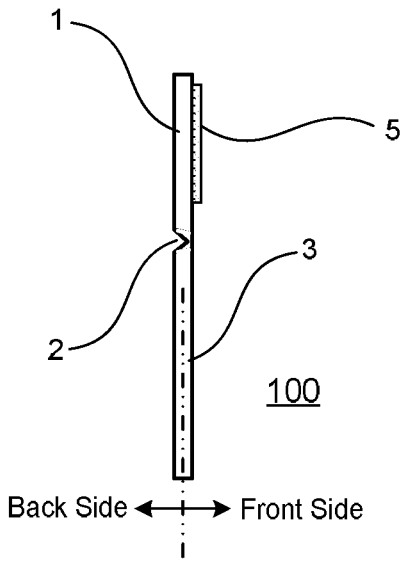
FIG. 3 is a cross-sectional view of the potty training device of the present invention depicted in FIG. 1 and FIG. 2, taken along line 3-3.
Figure 4:
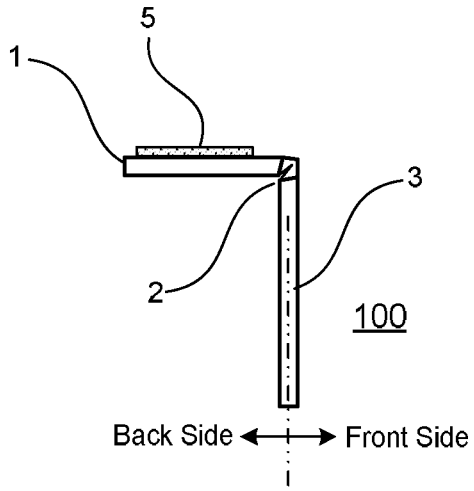
FIG. 4 is a cross-sectional view of the potty training device of the present invention shown in FIG. 3, having an L-shaped configuration.

The potty training device 100 is applied to the underside of the toilet seat 50 in a series of steps comprising: (i) folding the upper portion of the device 100, shown in FIGS. 1-3, along the folding seam 2, such that the angle between the top portion and the bottom portion on the back side of device 100 decrease to about 90 degrees, such that device 100 has an L-shaped configuration as shown in FIG. 4; (ii) manipulating the L-shaped device 100 into a curved configuration by bending the left and right edges of the urine-deflector 3 inward, such that the plurality of attachment tabs 1 separate, resulting in the curved configuration shown in FIG. 5; (iii) aligning the curved device 100 with the curvature of the underside of a toilet seat 50; and (iv) pressing the plurality of attachment tabs 1 against the underside of the toilet seat 50 in order to engage the adhesive material 5 on the surface of the attachment tabs 1, such that the adhesive material 5 secures the device 100 to the underside of the toilet seat 50.

While any means for attaching the potty training device 100 to the underside of a toilet seat 50 can be used, an adhesive material 5 is preferred. The adhesive material 5 is a preferably pressure-sensitive adhesive strip (such as, for example, "double sided tape") or pressure-sensitive resin that is applied to each attachment tab 1, and once applied to the underside of the toilet seat 50, is preferably strong enough to hold the potty training device 100 in place until physically removed by the consumer and not damage the finish of the toilet seat 50 during removal.

The adhesive material 5 is preferably water-resistant and non-porous. The adhesive material 5 is also preferably applied to the plurality of attachment tabs in a thin layer coating or as a thin sheet, where an adhesive strip is used. While not compromising the ability of the adhesive material 5 to hold the potty training device 100 in place, the application of the adhesive material 5 to the plurality of attachment tabs 1 should be as thin as possible, so as to not create large gaps between the potty training device 100 and the underside of the toilet seat 50. Such large gaps could allow urine to accumulate therein and contribute to excessive odor development. While it is understood that regardless of how thin the adhesive material 5 applied to the plurality of attachment tabs 1 is, small gaps may likely exist, and urine may find its way into such gaps by capillary action. The benefit of having small gaps, however, is that use of a cleaning solvent such as alcohol, will also enter the small gaps by capillary action and thereby reduce or eliminate odor development. Therefore, any gaps that are formed by the presence of the adhesive material 5 on the plurality of attachment tabs 1 should be as small as possible to aid in the ability to clean the potty training device 100.

Figure 5:
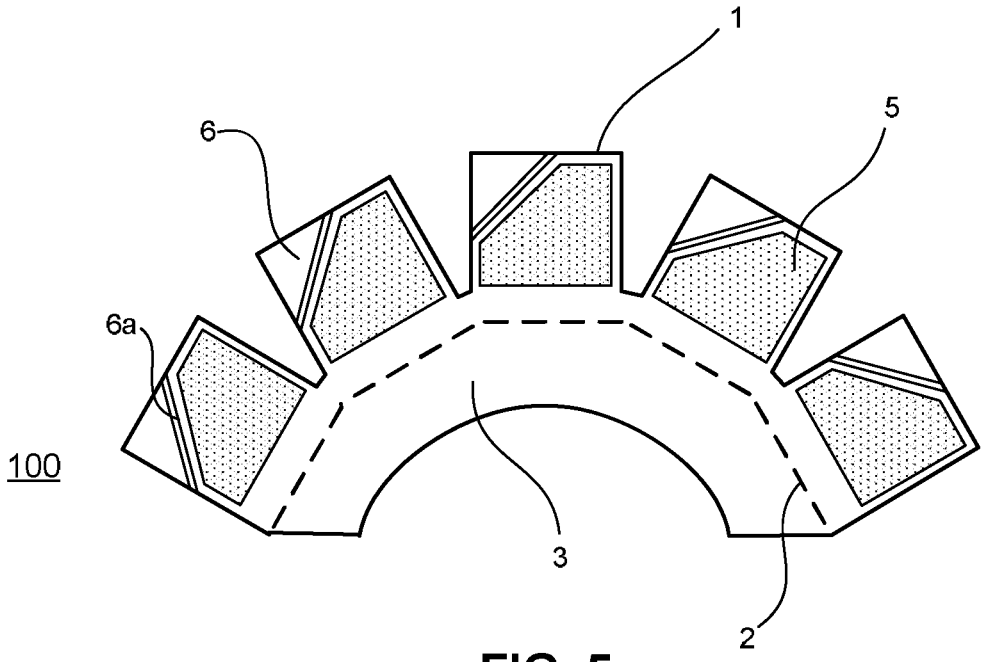
FIG. 5 is a top view of "front side" of the potty training device of the present invention in a curved configuration, showing separation of the top corners of adjacent attachment tabs.
Figure 6:
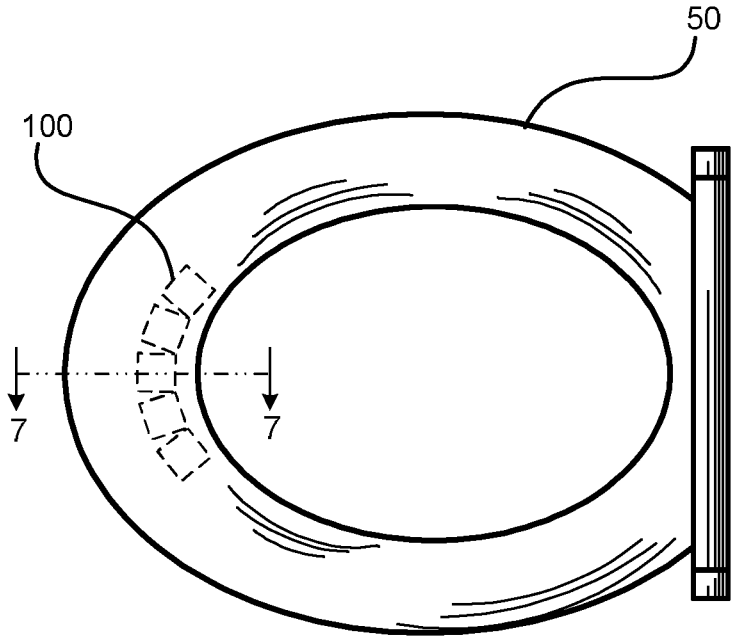
FIG. 6 is top view of the potty training device depicted in FIG. 5, attached to the underside of a toilet seat.

In order to assist with removal of potty training device 100 from the toilet seat, in another embodiment of the invention, each individual attachment tab 1 may comprise a release tab 6, as shown in FIGS. 2 and 5. The release tabs 6 allow the consumer to pull the potty training device 100 away from the toilet seat 50, without touching the urine-deflector 3. The release tabs 6 comprise a section of the attachment tabs 1, which does not contain any adhesive material 5, thereby allowing the consumer to, for example, grasp a non-adhesive containing section of the attachment tab 1 between their thumb and index finger, and pull the attachment tab 1 away from the toilet seat. By way of example, as shown in the drawings, the release tabs 6 are engaged by bending or folding down a small section of the attachment tab 1 along a bending or folding seam 6*a*.

While the release tabs 6 shown in the drawings represent one possible configuration for this element of the invention, other configurations for this element of the invention are also possible. Suitable configurations for the release tabs 6 are those that will allow the consumer to easily grasp a portion of the attachment tab 1 with their thumb and index finger and pull successive attachment tabs 1 away from the toilet seat 50 thereby removing the potty training device 100. Regardless of the configuration of this embodiment, the adhesive material 5 is not applied to the release tab 6. Once removed from the toilet seat 50, the potty training device 100 may be discarded in the trash.

In another embodiment of the present invention, the potty training device 100 is made from a flexible, water-resistant and preferably non-porous material. Any material having these characteristics is suitable for the invention. In a particular embodiment of the invention, the potty training device 100 is made from a rubber or plastic resin material, wherein a plastic resin material is particularly preferred. While any plastic resin material having the above characteristics can be used, plastic resin materials may be selected from, but not limited to: polyethylene, polypropylene, polystyrene, polyvinylchloride (PVC) and polytetrafluoroethylene (PTFE).

Other types of plastic resin materials that are suitable for making the potty training device 100 of the present invention include thermoplastic elastomer (TPE) materials. TPE materials are particularly preferred as they are well suited for use in injection molding processes, produce products that are flexible, strong and tear resistant, have a rubbery feel and texture, and are soft to the touch. Examples of TPE material suitable for making the potty training device of the present invention include, but are not limited to: ONFLEX, DYNAFLEX, KRATON, ARNTITEL, ENGAGE, HYTREL, DRYFLEX and MEDIPRENE. DYNAFLEX is a preferred TPE material for making the potty training device 100 of the present invention.

To further assist in maintaining the sanitary condition of the potty training device 100 of the present invention, may also be treated with any compound that inhibits the formation of odor, bacteria, mold or other urine associated growth. The potty training device 100 may also be a medical grade type material, such as a medical grade plastic for example, that is also resistant to the formation of odor, bacteria, mold or other urine associated growth, provided that the selected material has the desired flexibility characteristics previously described.

The invention has been described in terms of illustrative embodiments. It will be understood by those of ordinary skill in the art that various modifications and changes may be made to these embodiments without departing from the spirit or scope of the invention. It is intended that the invention not be limited in any manner by the embodiments shown and described herein.

What is claimed is:

1. A potty training device comprising:

a flexible sheet material having a top portion, a bottom portion, a left edge, a right edge, a front side and a back side;

a folding seam positioned on the back side of said flexible sheet material to permit folding of said flexible sheet material about the folding seam such that an angle between the top portion and the bottom portion on the back side decreases, wherein the folding seam extends horizontally between the left edge and right edge of said flexible sheet material and separates the said top portion of said flexible sheet material from the said bottom portion of said flexible sheet material; and a means for attaching said flexible sheet material to the underside of a toilet seat in such a way that after attaching said flexible sheet material to the underside of said toilet seat by said means for attaching, the flexible sheet material hangs entirely beneath the underside of said toilet seat, wherein said means for attaching is located on the front side of said flexible sheet material and within the upper portion of said flexible sheet material, and further wherein said bottom portion of said flexible sheet material, when folded about said folding seam, can be positioned to block an opening formed between the toilet seat and a toilet bowl to which said toilet seat is attached, and wherein a surface of said front side of said bottom portion serves as a urine-deflecting surface to deflect a urine stream directed towards said opening into the toilet bowl.

2. The potty training device according to claim 1, wherein said means for attaching said flexible sheet material to the underside of a toilet seat comprises an adhesive material applied to a plurality of attachment tabs.

3. The potty training device according to claim 2, wherein each attachment tab within said plurality of attachment tabs further comprises a release tab.

4. The potty training device according to claim 2, wherein said adhesive material is a pressure-sensitive adhesive resin or pressure-sensitive double-sided tape.

5. The potty training device according to claim 4, wherein said adhesive material is water-resistant.

6. The potty training device according to claim 5, wherein said potty training device is made from a plastic resin material.

7. The potty training device according to claim 6, wherein said plastic resin material is selected from: polyethylene, polypropylene, polystyrene, polyvinylchloride, polytetrafluoroethylene, or a thermoplastic elastomer.

8. The potty training device according to claim 7, wherein said plastic resin material is a thermoplastic elastomer.

9. A method of potty training comprising:

providing a potty training device according to claim 1;

attaching the device to the underside of a toilet seat with the aid of said means in a position to block an opening formed between the toilet seat and a toilet bowl to which said toilet seat is attached so that the urine-deflecting surface deflects a urine stream directed towards said opening into the toilet bowl.

10. The potty training method according to claim 9, wherein said means for attaching said flexible sheet material to the underside of a toilet seat comprises an adhesive material applied to a plurality of attachment tabs, and wherein said attaching of said device to the underside of a toilet seat comprises:

orienting said device with said folding seam facing an individual applying said device to the underside of a toilet seat;

placing a top edge of said plurality of attachment tabs against a surface of said underside of a toilet seat;

pressing said top edge of said plurality of attachment tabs against the surface of said underside of a toilet seat, thereby folding said sheet material along said folding seam such that the device has an L-shaped configuration, where an angle on the back side of the device between said attachment tabs and said urine-deflector is about 90 degrees;

bending the left and right edges of said bendable urine-deflector inward, while maintaining contact with said underside of said toilet seat, such that said plurality of attachment tabs separate and the curvature of the bendable urine-deflector comes to match the curvature of said toilet seat; and pressing said adhesive material on said attachment tabs now separated against the underside of a toilet seat to fix the curvature of the bendable urine-deflector as matching the curvature of the said toilet seat.

11. A method of potty training comprising:

providing a potty training device according to claim 1, wherein said means for attaching said flexible sheet material to the underside of a toilet seat comprises an adhesive material applied to a plurality of attachment tabs;

attaching the device to the underside of a toilet seat with the aid of said adhesive material in a position to block an opening formed between the toilet seat and a toilet bowl to which said toilet seat is attached so that the urine-deflecting surface deflects a urine stream directed towards said opening into the toilet bowl.

* * * * *